United States Patent [19]

Hostetler et al.

[11] Patent Number: 4,483,467

[45] Date of Patent: Nov. 20, 1984

[54] EXPANDABLE FABRIC MOLD

[75] Inventors: John E. Hostetler, Bettendorf; William H. Hulsebusch, DeWitt; I. Weir Sears, Jr., Davenport, all of Iowa

[73] Assignee: Apparel Form Company, Davenport, Iowa

[21] Appl. No.: 400,455

[22] Filed: Jul. 21, 1982

[51] Int. Cl.[3] ..... D06C 5/00

[52] U.S. Cl. ..... 223/74; 223/73

[58] Field of Search ..... 223/74, 72, 80, 77, 223/73, 63, 79; 2/227

[56] References Cited

U.S. PATENT DOCUMENTS

| | | | |
|---|---|---|---|
| 139,283 | 5/1873 | Viets | 223/74 |
| 156,900 | 11/1874 | Viets | 223/74 |
| 373,379 | 11/1887 | Rupprecht | 223/74 |
| 2,080,823 | 5/1937 | Jessen | 223/63 |
| 2,180,939 | 11/1939 | Leef | 223/73 |
| 3,550,820 | 12/1970 | O'Boyle | 223/73 |
| 3,556,361 | 1/1971 | O'Boyle | 223/73 |
| 3,763,499 | 10/1973 | Bartos et al. | 2/227 |
| 4,199,089 | 4/1980 | Filkow et al. | 223/79 |

*Primary Examiner*—Henry S. Jaudon
*Assistant Examiner*—J. L. Kravitz
*Attorney, Agent, or Firm*—Niro, Jager & Scavone

[57] ABSTRACT

An apparatus for use in forming fabric into a predetermined three-dimensional shape. The apparatus includes a contoured mold having at least two parts which are movable between a retracted position and an expanded position. A fabric holding mechanism is provided for holding a fabric shell placed over the mold in fixed position on the mold when the mold parts are in expanded condition. A driving assembly is mounted on one of the mold parts and operatively associated with the other mold part for effecting relative expansion thereof.

29 Claims, 5 Drawing Figures

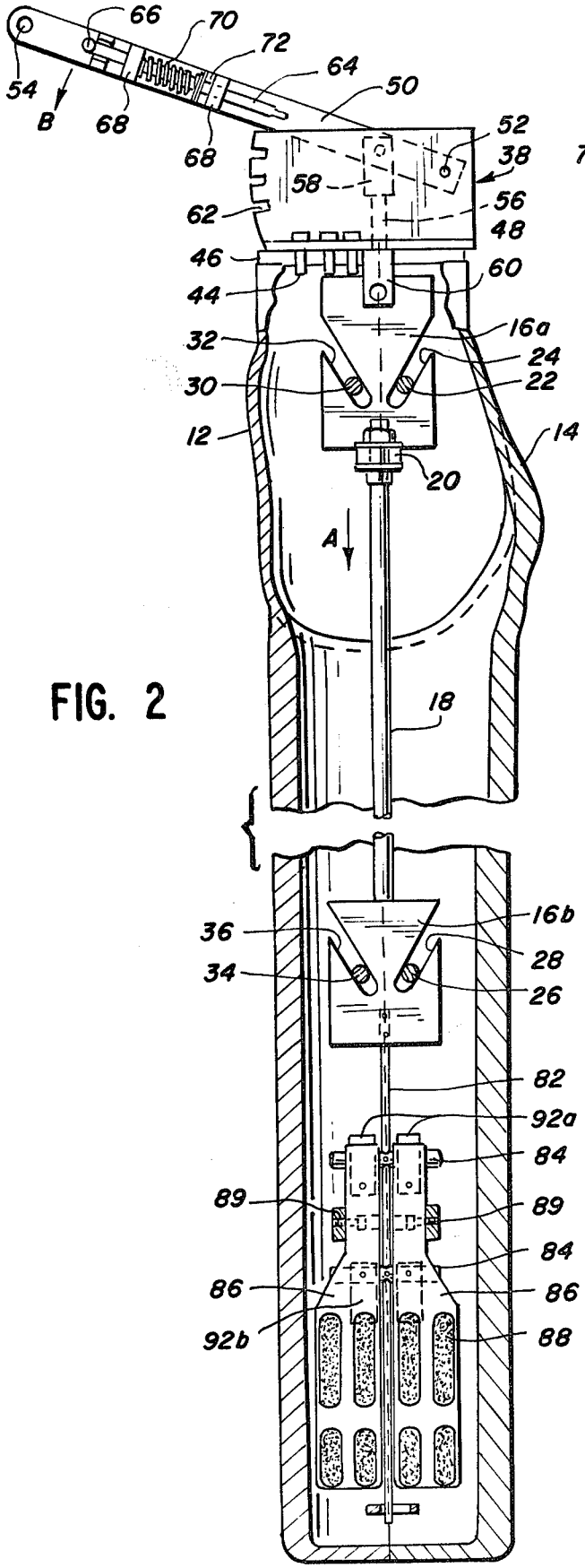
FIG. 2
FIG. 3
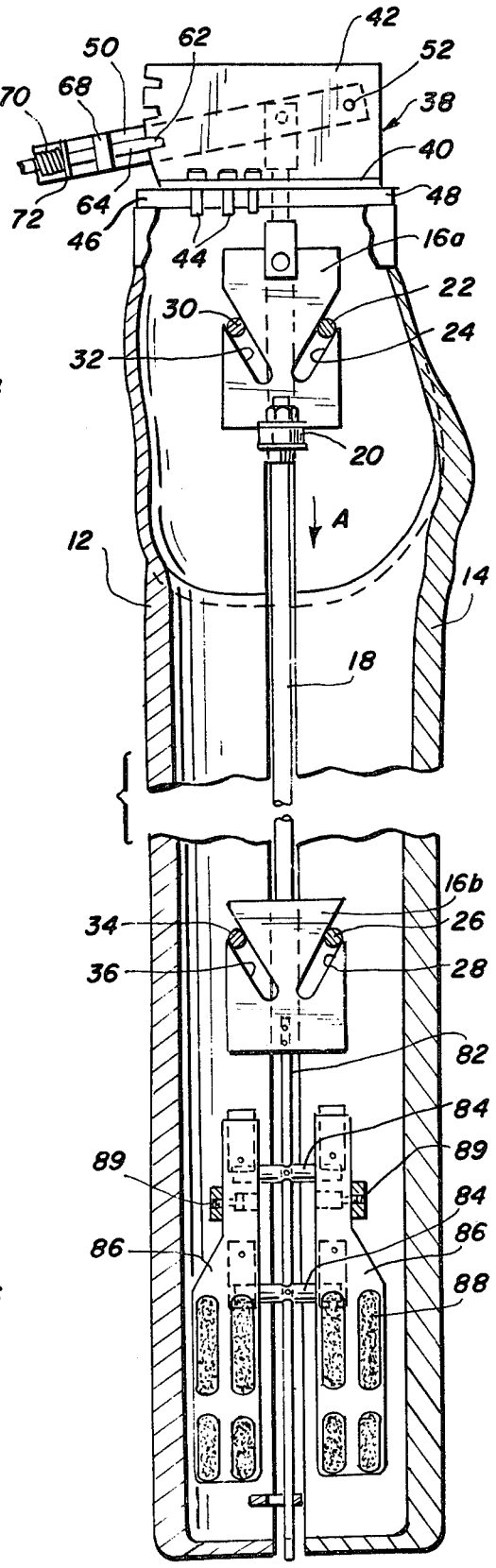

EXPANDABLE FABRIC MOLD

BACKGROUND OF THE INVENTION

This invention relates to an apparatus for use in forming fabric into a predetermined three-dimensional shape, and particularly to an apparatus which has improved means for expanding a fabric mold and for holding fabric placed over the mold when the mold is expanded.

In recent years there has been an ever increasing demand for relatively low cost, ready-to-wear garments that have a fine, tailored appearance and retain that appearance after extended use. In order to satisfy this demand, a variety of synthetic materials, either alone or blended with natural fibers, have been incorporated into fabric used to produce such garments. These fabrics, however, along with the traditional fabrics such as cotton and wool, must still be made into garments by conventional, time consuming, labor intensive techniques. Unfortunately, these manufacturing techniques unduly inflate the prices of the resulting ready-to-wear garments.

The conventional method of making cloth garments begins with cutting the cloth, in the flat, into a number of pieces which are arranged according to predetermined, often complex patterns. In order to minimize cutting costs, many layers of cloth are cut to the desired pattern at one time. This procedure, however, introduces size variation in the pieces, since the cutting knife may not hold precisely to the true garment pattern through the multiple layers of cloth. Conventional garment manufacture also requires that the cloth pieces of the pattern be joined or seamed, by sewing or welding, and darts employed where necessary to shape the garment. This is followed by pressing to improve fit and remove wrinkles. All of these steps are labor intensive and therefore expensive.

In addition, the seams of conventional tailored garments may pucker or open during manufacture or after extended wear and cleaning. Even if the seams do not open or pucker, they nevertheless constitute rigid intersections in the garment which tend to lessen the garment's wearing comfort. With multiple seams and darts, it is extremely difficult to produce a garment which faithfully conforms to the predetermined size and configuration of the desired apparel.

In view of these inherent disadvantages in conventional garment fabrication procedures, attempts have been made in the past to form garments by molding processes. Molded garments, for example, would be more economical to produce than garments produced in accordance with traditional manufacturing techniques, since the number of labor intensive steps and the amount of material waste would be greatly reduced. Consistency of sizing in the molded garments would be far superior to traditionally manufactured garments, since size variations in the garment prior to molding would be eliminated by the molding process. Also, molded garments would require far fewer seams and darts than traditionally manufactured garments in order to produce the desired shape. Molded garments would therefore be far less subject to the problem of opened and puckered seams, and would have greatly improved wearing comfort and durability, as well as appearance.

In copending application Ser. No. 289,254, filed Aug. 3, 1981, now abandoned, and assigned to the assignee of the present invention, an improved method of forming cloth into three-dimensional garments is disclosed. The method of that application highlights the failures of previous cloth molding processes, particularly in maintaining even or uniform tension across the garment during molding. Many processes prior to that disclosed and claimed in the aforesaid application, for example, stretch the garment in some places and shrink it in others or stretch the garment to differing degrees in different areas producing uneven tension and variations in fabric density throughout the garment and an unattractive, ill-fitting final product.

The invention of the aforesaid application includes a method of forming cloth into predetermined three-dimensional shapes from cloth shells. The method entails constructing a preformed cloth shell conforming to the shape of a mold contoured to correspond to the predetermined three-dimensional shape. The cloth shell is placed in tension over the mold, and the cloth shell is treated on the mold so that it will retain the predetermined shape when removed from the mold. The shape of the cloth shell generally conforms to the shape of the mold, so that substantially the entire shell will be under uniform tension on the mold.

The present invention is directed to providing a new and improved mold which facilitates rapid mounting of the shell onto the mold, provides uniform tensioning of the shell, and prevents the shell from moving or slipping while on the mold.

SUMMARY OF THE INVENTION

Accordingly, an object of the present invention is to provide a new and improved apparatus for use in forming fabric into a predetermined three-dimensional shape.

Another object of the present invention is to provide a new and improved expandable fabric mold for rapid mounting of a cloth shell onto the mold and for uniform tensioning of the shell while on the mold.

A further object of the present invention is to provide an expandable fabric mold which includes means for holding the fabric placed over the mold in fixed position when the mold is expanded.

In accordance with these and other objects of the present invention, an apparatus is disclosed for use in forming fabric into a predetermined three-dimensional shape. The apparatus includes a contoured mold having at least two movable parts. Means is provided for moving the mold parts between a retracted position and an expanded position. Means is also provided for holding a fabric shell placed over the mold in fixed position on the mold when the mold parts are in the expanded position.

In the exemplary embodiment of the invention, the contoured mold is configured in the shape of a pair of pants. The fabric holding means in this embodiment includes friction material on the mold for engaging the inside surface of the fabric when it is placed over the mold. The friction material may be disposed in a fixed position, such as in the waist area of the pants-shaped mold, for preventing movement of the fabric relative to the mold in that area.

The holding means may also be arranged with the friction material on movable means operatively associated with the means for expanding the mold. In this alternative arrangement, the movable means may be disposed within the peripheral bounds of the mold, such as the leg areas, when the mold parts are in their retracted position. When the mold is expanded, the movable means, with the friction material thereon, then moves through apertures in the mold to a position slightly outside the peripheral bounds of the mold to engage the inside surface of the fabric shell when the mold is expanded.

Another feature of the invention is the provision of new and improved means for actuating the mold parts to move between retracted and expanded positions. More particuarly, the actuating means includes cam means, mounted on one of the mold parts for movement relative thereto, and cam follower means, mounted on the other mold part for engagement with the cam means and arranged so that movement of the cam means relative to the one mold part effects relative expansion of the other mold part.

In the exemplary embodiment of the invention, the cam means includes a cam wedge mounted for linear movement on the one mold part. The cam follower on the other mold part is engageable with the cam wedge to expand the mold parts in a direction generally perpendicular to the direction of linear movement of the cam wedge. A cam wedge and cam follower is mounted in the torso area and both leg areas of the contoured mold.

In order to actuate the cam means, a pivot arm assembly is mounted on the one mold part for linearly moving the cam wedge. This pivot arm assembly may be manually operable, as in the illustrated embodiment, or it may be automatically operated by hydraulic, pneumatic or electrical means. Also, means is provided for selectively locking the pivot arm assembly to hold the mold parts in one of several alternative expanded positions.

Other objects, features and advantages of the invention will be apparent from the following description taken in connection with the accompanying drawings.

DESCRIPTION OF THE DRAWINGS

The features of this invention which are novel are set forth with particularity in the appended claims. The invention, together with its objects and advantages may be best understood by reference to the following description taken in conjunction with the accompanying drawings, in which like reference numerals identify like elements in the figures and in which:

FIG. 2 is a fragmented, vertical sectional view through the mold of FIG. 1, particularly through one leg portion thereof, with the mold in its retracted position;

FIG. 3 is a fragmented, vertical section view similar to that of FIG. 2, with the mold in its expanded position;

DETAILED DESCRIPTION OF THE INVENTION

Figure 1:
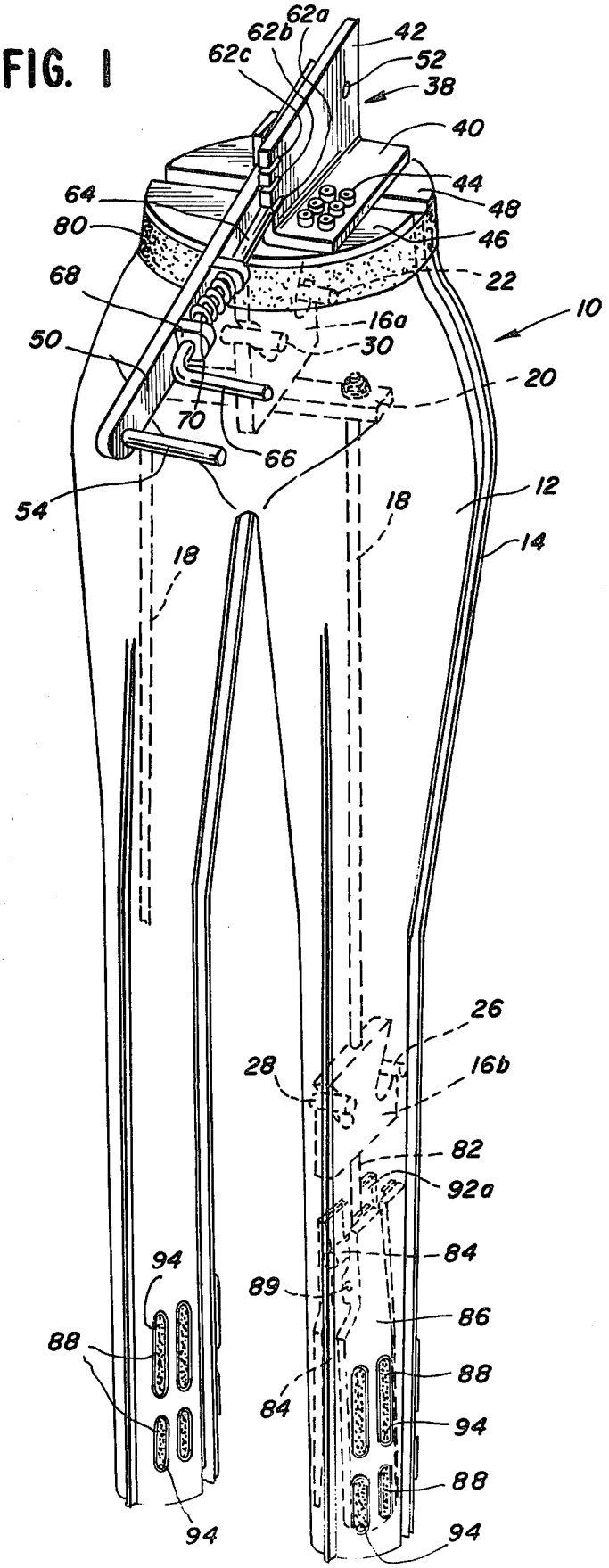
FIG. 1 is a front perspective view of the apparatus or contoured mold of the present invention, in expanded condition.

Referring to the drawings in greater detail and first to FIG. 1, an apparatus or mold, generally designated 10, is shown for use in forming fabric into a predetermined three-dimensional shape. Mold 10 is shown herein with a pants configuration, although it should be understood that the novel structure and features of the present invention are equally applicable for a wide variety of garment and other configurations.

Contoured mold 10 is configured in the shape of a pair of pants and has at least two movable parts, a front mold part 12 and a rear mold part 14, as viewed in the drawings.

Means is provided for moving the mold parts 12, 14 between a retracted position and an expanded position. FIG. 2 shows the mold in its retracted position and FIGS. 1 and 3 show the mold in its expanded, locked position. The means for moving the mold parts between the retracted and expanded positions generally includes means for transmitting linear, vertical movement of the operative components to horizontal or front-to-rear movement of mold parts 12 and 14. More particularly, the internal operative components include a plurality of cam wedge members **16*a* and 16*b* disposed within mold 10. Cam wedge 16*a* is disposed within the torso area of the mold, and one cam wedge 16*b* is disposed within each of the leg portions of the mold. The cam wedges 16*b* are interconnected to cam wedge 16*a* by drive rods 18 extending downwardly from a crossbar 20 fixed to the lower edge of cam wedge 16*a*. Thus, the cam wedges 16*a*, 16*b* of the driving assembly mounted within mold 10** move in unison, in a linear or vertical direction within the mold.

Cam follower means is operatively associated with cam wedges **16*a*, 16*b* for effecting horizontal expansion of mold parts 12, 14 in response to vertically downward movement of cam wedges 16*a*, 16*b*. More particularly, a cam follower pin 22 extends between flanges 23 (FIG. 4) on the inside of mold part 14 and is captured within an inclined slot 24 in cam wedge 16*a*. It should be noted that cam follower pin 22 is fixed on the inside of mold part 14. Similarly, a cam follower pin 26 is fixedly mounted within each leg portion of mold part 14 and is captured within an inclined slot 28 in each cam wedge 16*b*. Likewise, pin 30 is captured in an inclined slot 32 in cam wedge 16*a*, and pin 34 is captured within an inclined slot 36 in cam wedge 16*b*. These pins 30, 34 are fixed to and extend across the inside of front mold part 12 and move within slots 32, 36** for movement of the mold parts between their retracted and expanded positions.

FIG. 2 shows mold parts 12, 14 in their retracted position, with cam follower pins 22, 26 of mold part 14 disposed near the bottom of inclined slots 24, 28 of cam wedges **16*a*, 16*b*. FIG. 3 shows the mold parts 12, 14 in their expanded condition. In this condition, cam wedges 16*a*, 16*b* and drive rods 18 have been driven downwardly in the direction of arrow "A" (FIG. 3). As this downward, linear movement of the cam wedges is effected, cam follower pins 22, 26 ride upwardly and outwardly within inclined slots 24, 28 of the cam wedges to force rear mold part 14 rearwardly relative to front mold part 12 and, thus, to the relative expanded condition of FIG. 3. Of course, pins 32, 34 within front mold part 12 also ride up their respective inclined slots 32, 36 of cam wedges 16*a*, 16*b***.

Still referring to FIGS. 1–3, a pivot arm assembly, generally designated 38, which may be manually operable or automatically operable by hydraulic, pneumatic, or electrical means, is mounted on the top of mold 10 for operating the driving assembly comprising cam wedges **16*a*, 16*b* and the aforesaid related components. More particularly, pivot arm assembly 38 includes an angle bracket having a horizontal portion 40 and a vertical portion 42. Horizontal bracket portion 40 is fixedly mounted by six bolts 44 to a top wall 46 of front mold part 12. Rear mold part 14 has a top wall 48 which simply abuts against and moves laterally beneath bracket horizontal portion 40. In other words, the pivot arm assembly 38 actually is fixedly mounted to front mold part 12 in order to effect rearward expansion of mold part 14 by the driving assembly described hereinbefore. Of course, the mounting bracket could be secured to the rear mold part 14 rather than front mold part 12 and other "floating" mountings could be used, in view of the symmetrical configuration of cam wedges 16*a*, 16*b* and pins 22, 26, 30, 34**.

Pivot arm assembly 38 includes an arm 50 pivoted at 52 to vertical bracket portion 42 at one end of the arm, with a transverse handle 54 at the opposite end of the arm. As best seen in FIGS. 2 and 3, a vertical plunger 56 is pivotally connected at its upper end to arm 50 by a bushing 58 and secured at its lower end to cam wedge **16*a* by a bushing 60. Thus, it can be seen that pivoting arm 50 downwardly in the direction of arrow "B" (FIG. 2), causes plunger 56 to drive the interconnected cam wedges downwardly in the direction of arrow "A" to effect the aforesaid expansion of mold parts 12, 14**.

Means also is provided operatively associated with pivot arm assembly 38 for selectively locking the driving assembly in one of several alternative positions to hold the mold parts in an expanded position corresponding to the desired pants size. More particularly, a series of notches **62*a*, 62*b* and 62*c* are formed in the front edge of vertical bracket portion 42. A lock bolt 64, having a handle 66, is mounted on arm 50 for reciprocal movement within flanges 68 protruding from one side of the arm. Lock bolt 64, which is in transverse alignment with the notches, is spring loaded by a coil spring 70 sandwiched between front flange 68 and a washer 72 fixed to the lock bolt. When handle 66 is pulled forward, the rear end of lock bolt 64 is retracted relative to vertical bracket portion 42 and notches 62*a*–62*c* therein. Handle 66 would be moved by an operator while he simultaneously grasps handle 54 to pivot arm 50 to expand or collapse mold 10. Thus, when the mold is in the desired expanded position, lock bolt 64 will be in alignment with one of notches 62*a*, 62*b* or 62*c*, as shown in FIGS. 1 and 3, and release of handle 66 will permit coil spring 70** to force the lock bolt into the appropriate notch to hold the mold parts in the desired position.

Another feature of the invention is the provision of means for holding a fabric shell placed over mold 10 in fixed position on the mold when mold parts 12, 14 are expanded. Referring first to FIG. 1, the fabric holding means includes friction material 80 disposed in a band about the top of the mold in the "torso" area thereof. This friction material may be molded as a rough surface integral with the mold parts themselves, or the friction material may comprise a band, as shown, of grit paper, or the like, for engaging the inside surface of the fabric when it is placed over the mold.

Figure 4:
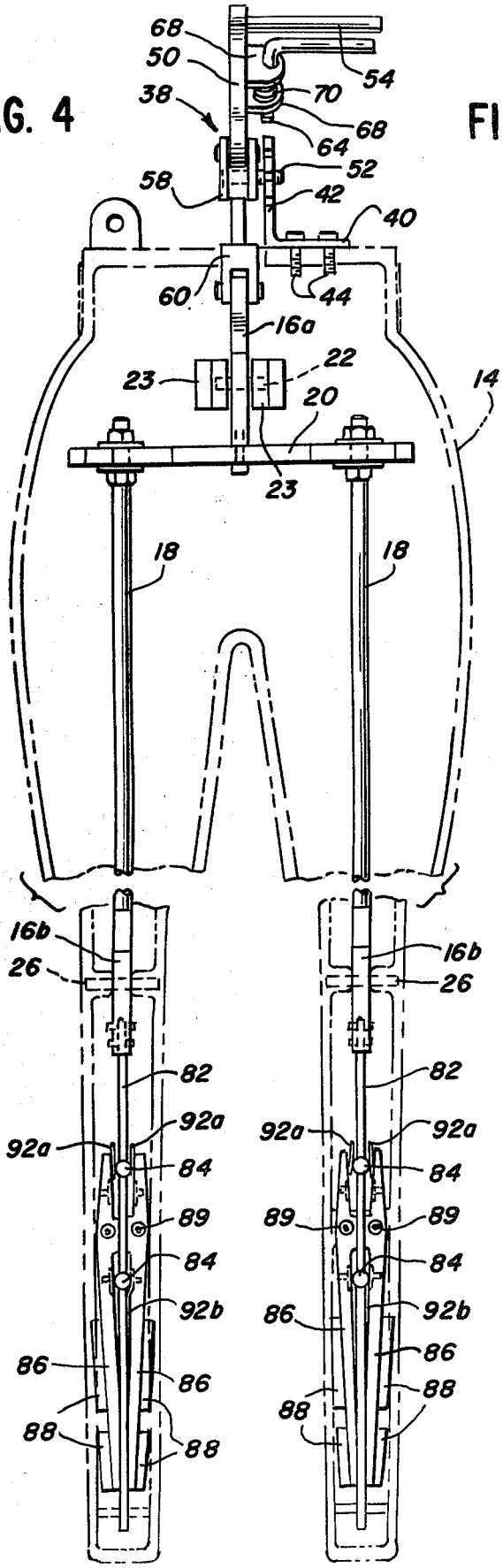
FIG. 4 is a fragmented, front elevational view of the internal components of the apparatus of the present invention, with the external contoured mold in phantom.
Figure 5:
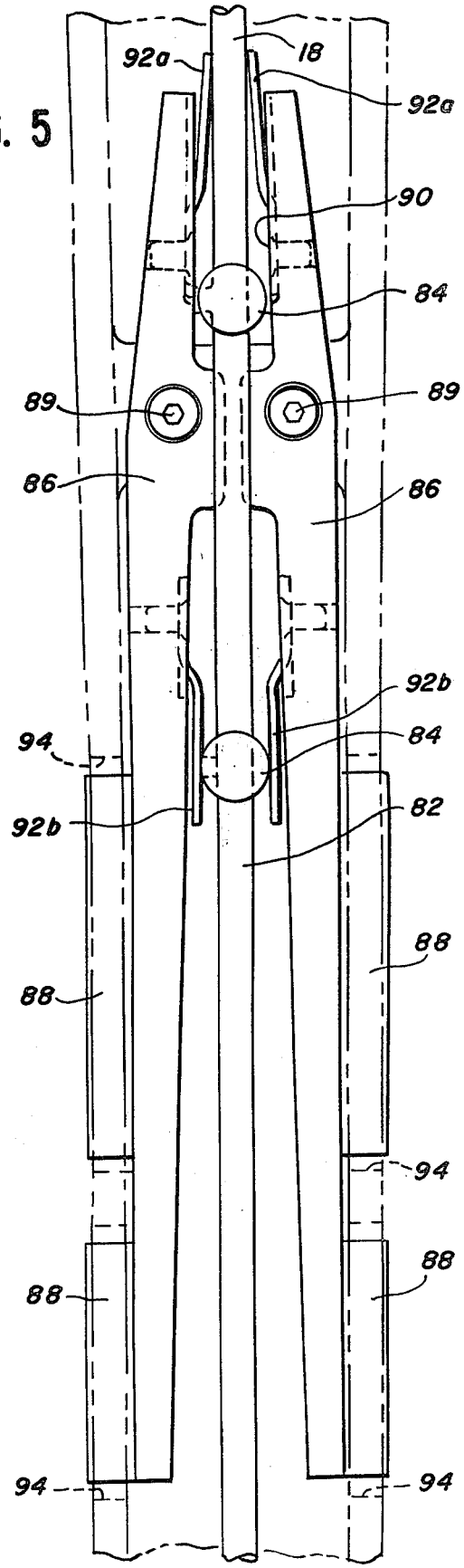
FIG. 5 is a fragmented, front elevational view, on an enlarged scale, of the fabric holding means in one leg portion of the mold.

The fabric holding means also includes friction material near the bottom of each leg portion of the mold. In this instance, the friction material is disposed on movable means operatively associated with the driving means of the apparatus, including cam wedges **16*b* in each leg portion of the mold. More particularly, a driving rod 82 is secured to and extends downwardly from each cam wedge 16*b* for vertical reciprocating movement therewith. Each drive rod 82 has a pair of spaced, transverse pins or rollers 84 fixed thereto and protruding outwardly from the rod in a front-to-rear direction. Pins 84 project between two pairs of jaws 86 disposed within each leg portion of mold 10. FIGS. 2 and 3 show the adjacent jaws of the two pairs thereof, while FIG. 5 shows both jaws of a single pair. The jaws have pads 88 (FIGS. 1–3) of friction material for engaging the inside surface of fabric placed over the mold. The jaws are pivoted at 89 so that the lower ends, having the friction pads thereon, are movable between positions within the peripheral bounds of the mold as shown in FIGS. 2 and 4, to positions wherein fricton pads 88 are positioned outside the peripheral bounds of the mold in engagement with the inside surface of the fabric when the mold parts are expanded, as shown in FIGS. 1, 3 and 5**.

Pivotal movement of jaws 86 is effected by pins 84 projecting outwardly from drive rod 82. In particular, it can be seen best in FIG. 5 that the inside of jaws 86 are cut away, as at 90, above and below pivot pins 89. These cut out areas are reduced in size away from the pivot pins by leaf springs **92*a* above the pivot pins and by leaf springs 92*b* below the pivot pins. Thus, as seen in FIG. 4, upper pin 84 on drive rod 82 is in engagement with upper leaf springs 92*a* to pivot the jaws so that friction pads 88 are disposed within the mold, while lower pin 84 on drive rod 82 is freely disposed within the cut out areas between the jaws. As the driving assembly of the apparatus is moved downwardly to expand mold parts 12 and 14, drive rod 82 moves downwardly therewith until lower pin 84 is disposed between leaf springs 92*b* and upper pin 84 is free of leaf springs 92*a* within the cut out portions between the jaws. In this position, pin 84 expands the jaws and moves friction pads 88 through aperatures 94** in the mold parts so that the friction pads project outwardly beyond the peripheral bounds of the mold parts. In this projected condition of the friction pads, the pads engage the inside surface of the fabric when the mold parts are in their expanded condition to hold the fabric in fixed position on the mold.

Thus, it can be seen that a new and improved apparatus or mold is provided for use in forming fabric into a predetermined three-dimensional shape, with novel means for expanding relatively movable parts of a contoured mold to provide uniform tension in the fabric shell, with novel fabric holding means operatively associated with the mold expanding means for conjoint operation.

It will be understood that the invention may be embodied in other specific forms without departing from the spirit or central characteristics thereof. The present examples and embodiments, therefore, are to be considered in all respects as illustrative and not as restrictive, and the invention is not to be limited to the details given herein.

What is claimed is:

1. An apparatus for use in forming a fabric shell into a predetermined three-dimenional shape, comprising:

a contoured mold having at least two movable parts extending throughout substantially the entire fabric shell;

means for moving said mold parts between a retracted position and an expanded position; and means at spaced positions on said mold for multidirectional holding of a fabric shell placed over said mold in fixed position on said mold to prevent movement of the fabric shell relative to said mold in opposed directions when said mold parts are in said expanded position.

2. The apparatus of claim 1 wherein said fabric holding means includes friction material on said mold for engaging the inside surface of said fabric when placed over said mold.

3. An apparatus for use in forming a fabric shell into a predetermined three-dimensional shape, comprising:

a contoured mold having at least two movable parts;

means for moving said mold parts between a retracted position and an expanded position; and means operatively associated with said moving means for movement relative to said mold parts for engaging the inside surface of a fabric shell placed over said mold and holding the fabric shell in fixed position on said mold to prevent movement of the fabric shell relative to the mold parts when the mold parts are in said expanded position.

4. The apparatus of claim 3 wherein said engaging means is adapted to be moved to an expanded position relative to said mold parts in engagement with said inside surface of the fabric shell as said mold parts are moved to their expanded position.

5. An apparatus for use in forming a fabric shell into a predetermined three-dimensional shape, comprising:

a contoured mold having at least two movable parts;

means for moving said mold parts between a retracted position and an expanded position; and means operatively associated with said moving means for engaging the inside surface of a fabric shell placed over said mold and holding the fabric shell in fixed position on said mold when said mold parts are in said expanded position, said engaging means being disposed within the peripheral bounds of said mold when said mold parts are in their retracted position, said engaging means being adapted to be moved to an expanded position in engagement with the inside surface of the fabric shell as said mold parts are moved to their expanded position.

6. The apparatus of claim 5 wherein said engaging means is disposed beyond the peripheral bounds of said mold in engagement with the inside surface of said fabric shell when said mold parts are in their expanded position.

7. The apparatus of claim 6 wherein said engaging means includes at least two relatively movable portions positioned on opposite sides of said mold.

8. The apparatus of claim 7 wherein said engaging means are positioned within at least one leg portion of a pants-shaped mold.

9. The apparatus of claim 8 wherein said mold includes a waist portion, and said holding means includes friction material positioned at said waist portion for engaging the inside surface of said fabric shell in the torso area thereof.

10. The apparatus of claim 9 wherein said relatively movable portions on opposite sides of said mold include friction material for engaging the inside surface of said fabric shell in the leg areas thereof.

11. The apparatus of claim 4 wherein said engaging means includes friction material for engaging said inside surface of the fabric shell.

12. The apparatus of claim 1 wherein said mold is elongated and said holding means includes means near opposite ends of the said mold for holding the fabric shell when said mold parts are in said expanded position.

13. A forming apparatus for a three-dimensional shaped fabric shell, comprising:

at least a pair of relatively movable members about which said fabric shell is placed for tensioning said fabric shell, said movable members extending throughout substantially the entire fabric shell; and means at spaced positions on at least one of said members for multidirectional holding of said fabric shell in opposed directions and in fixed relation relative to said one member when so tensioned.

14. The apparatus of claim 13 wherein said fabric holding means includes friction material on said one member for engaging the inside surface of said fabric when placed over said one member.

15. A forming apparatus for a three-dimensionally shaped fabric shell, comprising:

at least a pair of relatively movable members about which said fabric shell is placed for tensioning said fabric shell; and means on at least one of said members for holding said fabric shell in fixed relation thereto when so tensioned, said fabric holding means including means movable relative to said one member to an expanded position in engagement with the inside surface of said fabric.

16. The apparatus of claim 15 wherein said movable means travels from a retracted position within the peripheral bounds of said one member to an expanded position beyond the peripheral bounds of said one member into engagement with the inside surface of said fabric shell.

17. The apparatus of claim 16 wherein said one member includes an aperture through which said movable means moves from said retracted position to said expanded position.

18. The apparatus of claim 15 wherein said movable means includes friction material for engaging the inside surface of said fabric shell.

19. An apparatus for use in forming a fabric shell into a predetermined three-dimensional shape, comprising:

a contoured mold having at least two movable parts; and means for moving said mold parts between a retracted position and a relative expanded position, said moving means including cam means mounted on one of said mold parts for rectilinear movement relative thereto, means mounted on said one mold part and operatively associated with said cam means for moving said cam means, and cam follower means mounted on the other of said mold parts for engagement with said cam means whereby said rectilinear movement of said cam means relative to said one mold part effects relative expansion of said other mold part.

20. The apparatus of claim 19 wherein said cam means includes a cam wedge mounted for linear movement on said one mold part and operatively engageable with said cam follower on said other mold part to expand the other mold part in a direction generally perpendicular to the direction of said linear movement of said cam wedge.

21. An apparatus for use in forming a fabric shell into a predetermined three-dimensional shape, comprising:

a contoured mold having at least two movable parts; and means for moving said mold parts between a retracted position and a relative expanded position, said moving means including cam means mounted on one of said mold parts for movement relative thereto and cam follower means mounted on the other of said mold parts for engagement with said cam means whereby movement of said cam means relative to said one mold part effects relative expansion of said other mold part, said cam means including a cam wedge mounted for linear movement on said one mold part and operatively engageable with said cam follower means on said other mold part to expand the other mold part in a direction generally perpendicular to the direction of said linear movement of said cam wedge, and a pivot arm assembly mounted on said one mold part for moving said cam wedge.

22. The apparatus of claim 21, including means for locking said pivot arm assembly to hold said mold parts in an expanded position.

23. An apparatus for use in forming a fabric shell into a predetermined three-dimensional shape, comprising:

a contoured mold having at least two movable parts; and means for moving said mold parts between a retracted position and a relative expanded position, said moving means including cam means mounted on one of said mold parts for movement relative thereto and cam follower means mounted on the other of said mold parts for engagement with said cam means whereby movement of said cam means relative to said one mold part effects relative expansion of said other mold part, said cam means including a cam member having a slot disposed at an angle to the direction of expansion of said mold parts, and said cam follower means comprises a pin member captured by said slot.

24. An apparatus for use in forming a fabric shell into a predetermined three-dimensional shape, comprising:

a contoured mold having at least two movable parts;

means for moving said mold parts between a retracted position and a relative expanded position, said moving means including cam means mounted on one of said mold parts for movement relative thereto and cam follower means mounted on the other of said mold parts for engagement with said cam means whereby movement of said cam means relative to said one mold part effects relative expansion of said other mold part; and a manually operable pivot arm assembly mounted on said one mold part for operating said moving means.

25. The apparatus of claim 19, including means for selectively locking said moving means to hold said mold parts in an expanded position.

26. An apparatus for use in forming a fabric shell into a predetermined three-dimensional shape, comprising:

a shaping mold having at least two movable parts; and means for moving said mold parts between a retracted position and a relative expanded position, said moving means including a driving assembly mounted on said mold, said driving assembly having a driving member mounted on said mold for rectilinear movement relative thereto, means mounted on said mold and operatively associated with said driving member for moving said driving member, and at least one reacting member operatively associated between said driving member and at least one of said mold parts to expand the mold parts in response to said linear movement of said driving member.

27. The apparatus of claim 26, including a manually operable pivot arm assembly mounted on said mold for operating said driving assembly.

28. The apparatus of claim 27, including means operatively associated with said pivot arm assembly for selectively locking said driving assembly in position to hold said mold parts in the expanded position.

29. The apparatus of claim 26, including means for selectively locking said moving means to hold said mold parts in an expanded position.

* * * * *